US012103731B2

(12) United States Patent
West et al.

(10) Patent No.: US 12,103,731 B2
(45) Date of Patent: Oct. 1, 2024

(54) MODULAR CONTAINER SYSTEM WITH CORNER COUPLERS

(71) Applicant: Radius Outfitters INC., Monterey, CA (US)

(72) Inventors: Cody West, Carmel Valley, CA (US); Asa Engstrom, Monterey, CA (US)

(73) Assignee: Radius Outfitters, Monterey, CA (US)

( * ) Notice: Subject to any disclaimer, the term of this patent is extended or adjusted under 35 U.S.C. 154(b) by 70 days.

(21) Appl. No.: 17/300,720

(22) Filed: Oct. 2, 2021

(65) Prior Publication Data

US 2022/0033137 A1 Feb. 3, 2022

Related U.S. Application Data

(63) Continuation-in-part of application No. 17/300,533, filed on Aug. 3, 2021, now abandoned.

(60) Provisional application No. 63/103,392, filed on Aug. 3, 2020.

(51) Int. Cl.
*B65D 6/18* (2006.01)
*B65D 6/24* (2006.01)

(52) U.S. Cl.
CPC ..... *B65D 11/1833* (2013.01); *B65D 11/1893* (2013.01)

(58) Field of Classification Search
CPC ..... B65D 11/1833; B65D 11/1893
See application file for complete search history.

(56) References Cited

U.S. PATENT DOCUMENTS

| | | | | |
|---|---|---|---|---|
| 5,279,438 | A * | 1/1994 | Cesano | B65D 11/1833 220/684 |
| 5,377,857 | A * | 1/1995 | Taravella | B65D 5/006 229/198.2 |
| 5,529,199 | A | 6/1996 | Foster | |
| 5,538,178 | A * | 7/1996 | Zink | B65D 19/06 493/115 |
| 5,634,539 | A * | 6/1997 | Gordon | A45C 5/02 217/65 |
| 5,765,707 | A | 6/1998 | Kenevan | |
| 6,749,077 | B1 * | 6/2004 | McAlpine | B65D 11/1833 220/4.33 |
| 6,752,285 | B1 | 6/2004 | Scalf | |
| 9,139,331 | B2 | 9/2015 | Tavolino | |
| 9,146,771 | B2 | 9/2015 | He et al. | |
| 9,512,866 | B2 | 8/2016 | Gerstle | |
| 9,714,113 | B2 | 7/2017 | Jung et al. | |

* cited by examiner

*Primary Examiner* — Stephen J Castellano
(74) *Attorney, Agent, or Firm* — James A. Gavnay; JAG Patent Services

(57) ABSTRACT

A modular container has a container body that includes a bottom panel and four side panels that are hingably and flexibly attached to four edges of the bottom panel. The side panels have elongated piping support structures that extend along each side edge of the side panels and are attached together in an assembled positioned through corner couplers with matched elongated channels that fit over the elongated piping support structures to secure the adjacent side panels into and upright and assembled position.

9 Claims, 5 Drawing Sheets

MODULAR CONTAINER SYSTEM WITH CORNER COUPLERS

RELATED APPLICATION

This application is a continuation-in-part of U.S. patent application Ser. No. 17/300,533, filed on Aug. 3, 2021, and titled "MODULAR CONTAINER SYSTEM WITH CORNER COUPLERS." This application also claims priority under 35 U.S.C. § 119(e) from the U.S. provisional patent application Ser. No. 63/103,392, filed on Aug. 3, 2020, and titled "FOR MODULAR VEHICLE CONVERSION SYSTEM." The U.S. patent application Ser. No. 17/300,533, filed on Aug. 3, 2021, now abandoned, and titled "MODULAR CONTAINER SYSTEM WITH CORNER COUPLERS" and the provisional patent application Ser. No. 63/103,392, filed on Aug. 3, 2020, and titled "FOR MODULAR VEHICLE CONVERSION SYSTEM" are both hereby incorporated by reference.

FIELD OF THE INVENTION

The present invention relates to containers. More specifically, this invention relates to containers that are built with panels and corner couplers.

BACKGROUND OF THE INVENTION

Containers are built for a number of storage and shipping purposes and are formed from a number of different materials. Fully built containers themselves create a storage challenge when not being used and are expensive to ship due to large volumes of unused space that they occupy. To address the aforementioned shortcoming shipping containers are usually custom built or modular containers are made to be collapsible or assembled from prefabricated parts.

SUMMARY OF THE INVENTION

The present invention is directed to modular container that are formed from prefabricated parts. The modular container preferably includes a container body that includes a bottom panel and four side panels that are hingably and flexibly attached to four edges of the bottom panel. The bottom panel and the side panels of the container body are formed from the same materials or different materials. Suitable materials to form the bottom panel and the side panels include, but are not limited to plastics or polymers, woven materials and cloth (with or without internal support structures), metals and composite materials.

The modular container can also include a bottom panel or side panel inserts to fit into an assembled modular container or are held within pocket or sleeves on the bottom and/or side panels to add rigidity to the assembled module container. In further embodiments of the invention the modular container includes dividers that fit into the assembled modular container and attach to walls of the bottom panel and/or side panels through attachment features including, but not limited to, two part snap features, hook and loop fabric and matted tongue and grove-type slotted features or combinations thereof.

The modular container can also be equipped to a top that fits over a container cavity of the assembled modular container and the side panels can be equipped with handle features on the outer surfaces of the side panels for porting the assembled modular container.

In accordance with the embodiments of the invention, elongated piping support structures extend along each side edge of four side panels. The elongated piping support structures are continuous or can be segmented. The elongated piping support structures can have any suitable cross-sectional shape, but preferably have circular cross-sectional shapes. The elongated piping support structures are formed from any suitable materials including, but not limited to, plastics or polymers, composite materials, metals and combination thereof.

The elongated piping support structures are attached to the side edges of the side panels by any suitable method including clamping methods, glues, samples, screws and/or are sewed along the side edges of the side panels. Preferability, the elongated piping support structures are co-molded onto the side edges of the side panels when the side panel are formed or made.

The modular container is assembled using corner couples. The corner couplers include two matched elongated channels that are preferably continuous. The matched elongated channels have a cross-sectional shape that matches the cross-sectional shape of the elongated piping support structures, such that the elongated piping support structures can be fitted into the matched elongated channels and the corner couplers can be pushed down along two opposed elongated piping support structures on adjacent side panels and secure the two adjacent side panels into and upright and assembled position.

The corner couplers include an open receiving end that is fitted onto ends the elongated piping support structures on the adjacent side panels, such as described above, and pushed onto the elongated piping support structures on the adjacent side panels placing the elongated piping support structures into the matched elongated channels of the corner couplers. The corner couplers also preferably includes closed finished end that is positioned at or near top edges of the side panels with side panels in the upright assembled position. The closed or finished end can be configured to attach to or secure to a top that fits over a container cavity of the assembled modular containers using any suitable attachment mechanism including, but not limited to, compression fittings, hook and loop fabric, magnets, straps, snap features and combinations thereof.

The corner couplers of the present invention also include an elongated tongue feature that extends between the matched elongated channels and from the closed finished end down to near open receiving ends of the corner couplers. When the modular container is assembled, the elongated tongue feature extends along inner corners formed by adjacent side panels and provides additional structural support and rigidity to the assembled modular container. When the corner couplers are placed in the assembled position by sliding open receiving ends of the corner couplers down along the elongated piping support structures of adjacent side panels, the corner couplers are secures into the assembled position by compression, snap features, matched lock features on the corner couplers and the bottom panels, side panels and the elongated piping support structures or any other suitable method.

DETAILED DESCRIPTION OF THE INVENTION

Figure 1A:
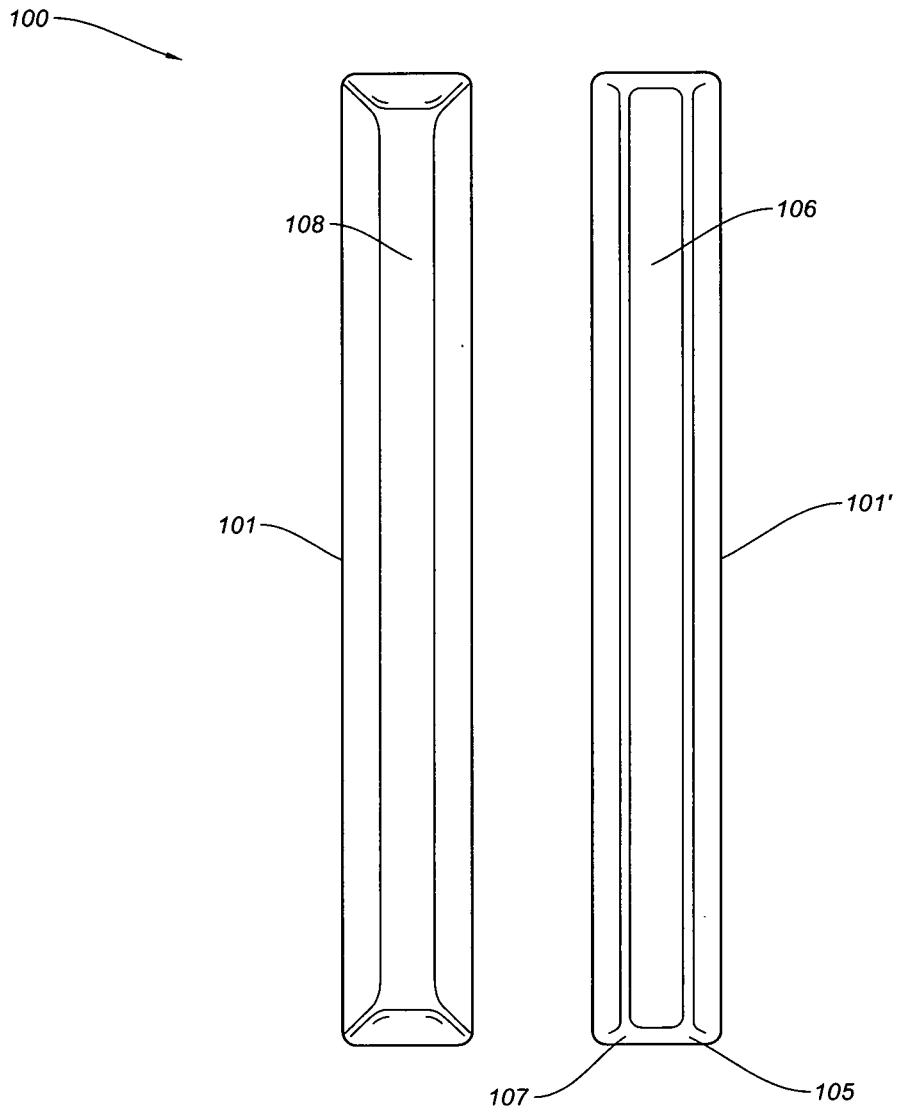
FIGS. 1A-B show views a corner coupler for building a modular container, in accordance with the embodiments of the invention.
Figure 1B:
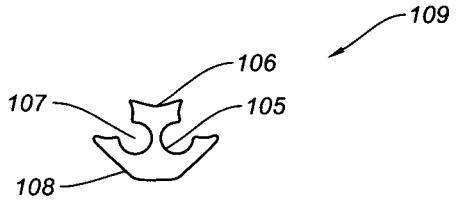

FIG. 1A-B show views 100 and 109 a corner coupler for building a modular container. The front portion 101 of the corner coupler has a finished or rounded face 108 while the back portion 101' of the corner couple has two matched continuous elongated channels 105 and 107. Between the two matched continuous elongated channels 105 and 107 there is and elongated tongue feature 106 that extends along the length of the back portion 101' of the corner coupler. Corner couplers of the present invention are formed from any suitable materials including, but not limited to, plastics or polymers, composite materials, metals and combination thereof.

Figure 2:
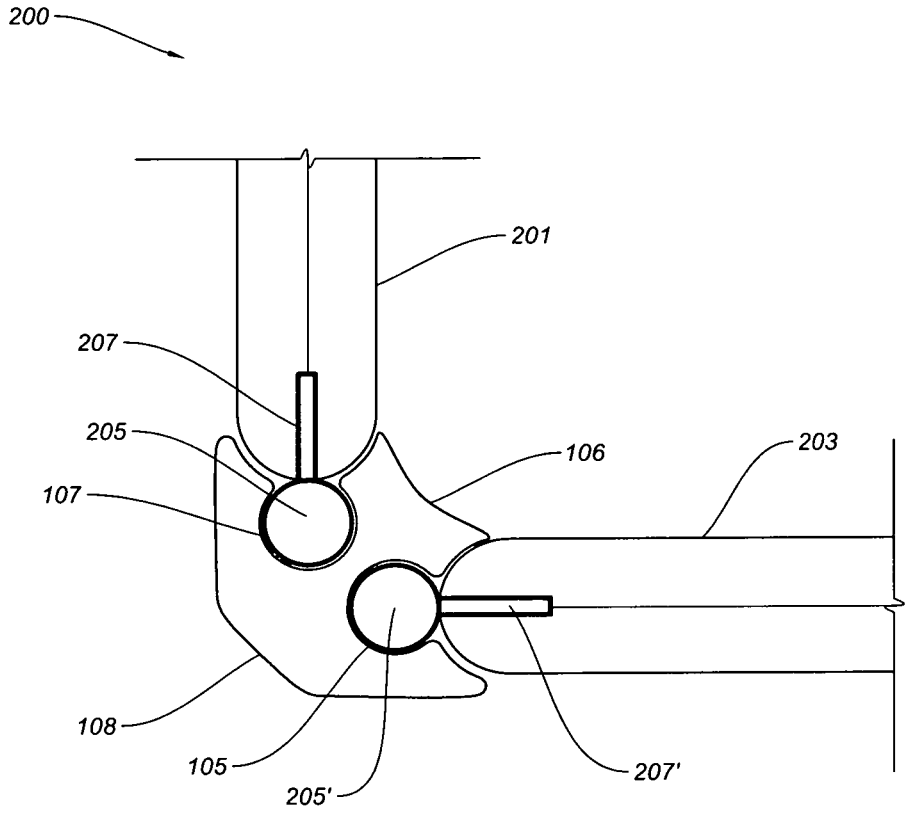
FIG. 2 is a perspective of an assembled corner section of a modular container using the corner coupler shown in FIG. 1, in accordance with the embodiments of the invention.

FIG. 2 shows an assembled corner section 200 of a modular container using the corner coupler shown in FIG. 1. Two adjacent side panels 201 and 203 of a modular container have elongated piping support structures 205 and 205'. The elongated piping support structures 205 and 205' are attached to edges of the adjacent side panels 201 and 203 through any suitable means including elongated tab structures 207 and 207' that are glued or sewn between portions of the adjacent side panels 210 and 203. Alternatively, the elongated tab structures 207 and 207' are attached to the adjacent side panels 201 and 203 using any suitable means including, but not limited to, screws staples and clamp features. Preferability, the elongated piping support structures 205 and 205' are co-molded onto the side edges of the side panels 201 and 203 when the side panels 201 and 203 are formed or made. The elongated piping support structures 205 and 205' are formed from any suitable materials including, but not limited to, plastics or polymers, composite materials, metals and combination thereof.

In operation the elongated piping support structures 205 and 205' are fitted into and pushed into the two matched continuous elongated channels 105 and 107, such that the back portion 101' of the corner coupler forms an interior corner of the modular container and the front portion 101 of the corner coupler forms an exterior corner of the modular container.

Figure 3:
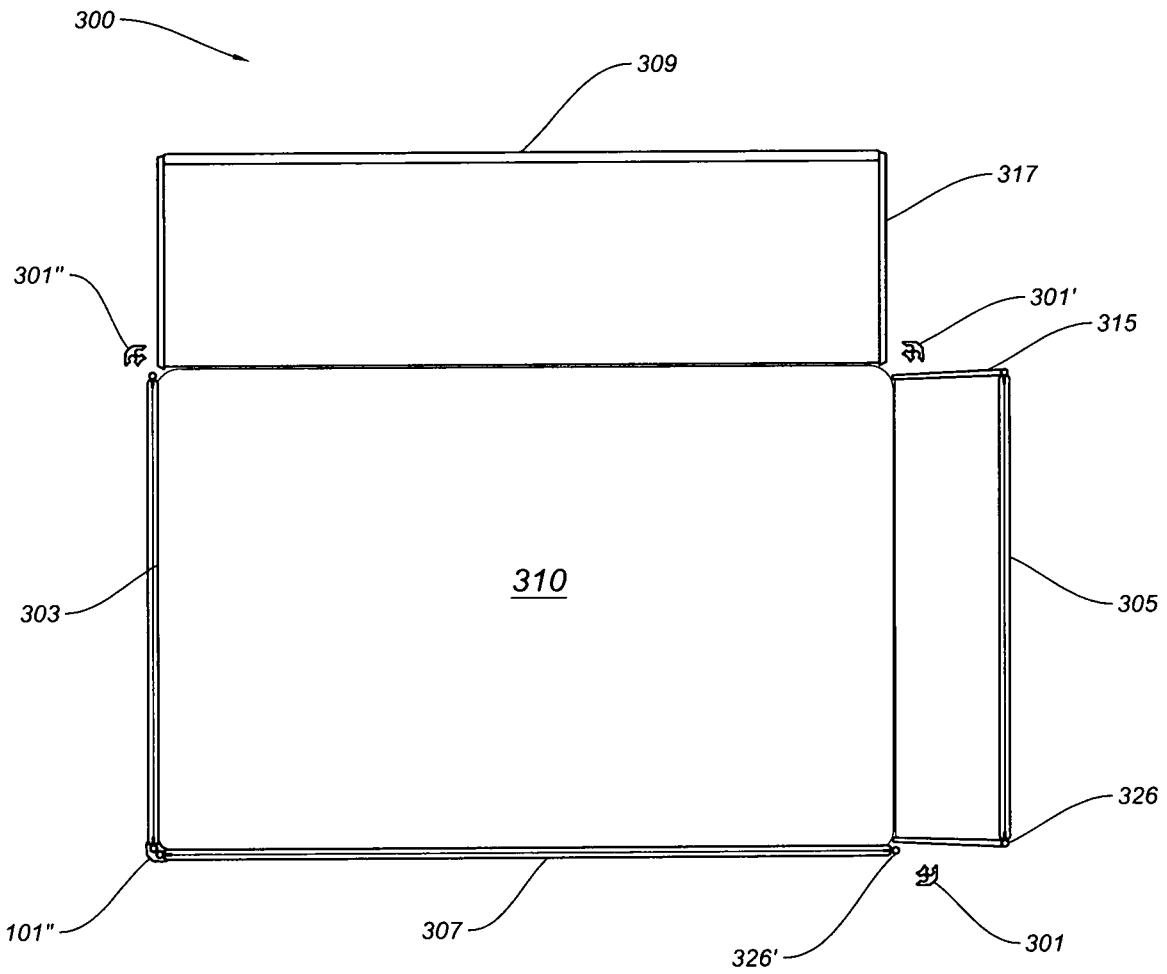
FIG. 3 is a perspective view of an partially assembled modular container using corner couplers, in accordance with the embodiments of the invention.

FIG. 3 is a perspective view of an partially assembled modular container 300 using corner couplers, in accordance with the embodiments of the invention. The modular container 300 preferably includes a container body that includes a bottom panel 310 and four side panels 303, 305, 307 and 309 that are hingably and flexibly attached to four edges of the bottom panel 310. The bottom panel 310 and the side panels 303, 305, 307 and 309 of the modular container 300 are formed from the same materials or different materials. Suitable materials to form the bottom panel 310 and the side panels 303, 305, 307 and 309 include, but are not limited to plastics or polymers, woven materials and cloth (with or without internal support structures), metals and composite materials.

In operation, the modular container 300 is formed by sliding elongated piping support structures 315 and 317 on adjacent side panels 305 and 309 into two matched elongated channels 105 and 107 (FIGS. 1A-B and FIG. 2) of a corner coupler 310', such as described with reference to FIG. 2 above. There are, for example, four such corner couplers 301, 310' 301" and 101" that form the four corners of a fully assembled modular container.

Figure 4:
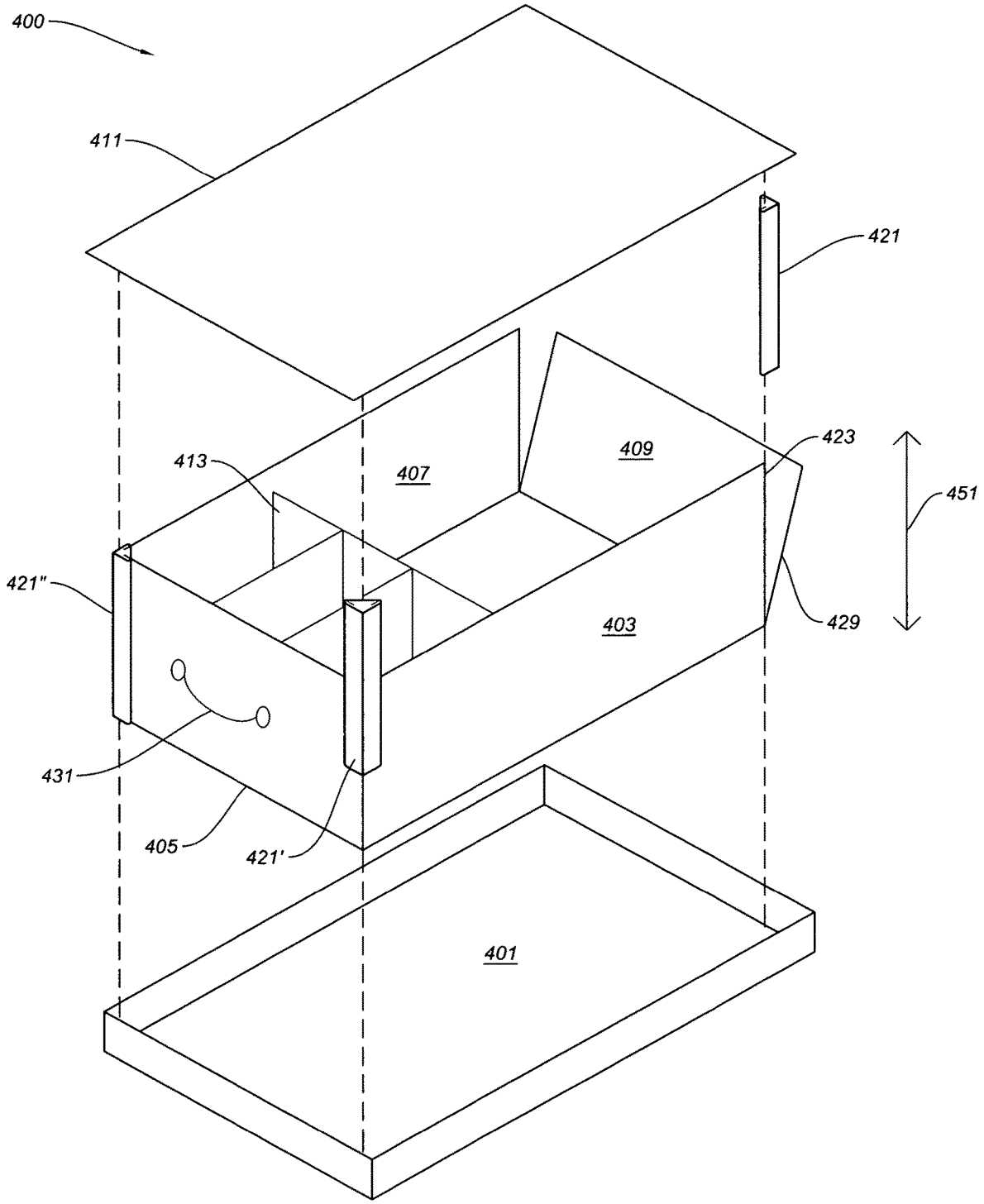
FIG. 4 shows an exploded view of a modular container with corner couplers, side panels, a bottom panel, a top panel or cover and a sectional insert or compartment divider, in accordance with the embodiments of the invention.
Figure 5A:
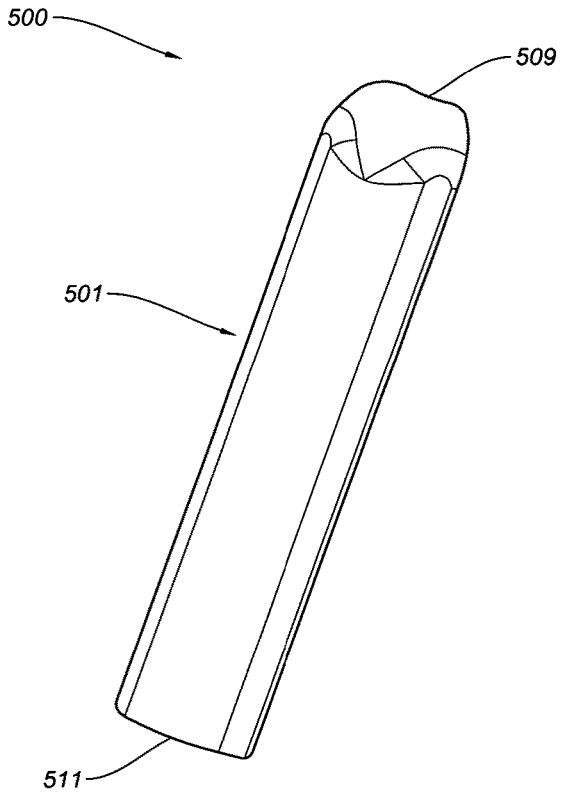
FIGS. 5A-D show a corner coupler with a two matched continuous elongated channels, and tongue feature, an open receiving end and a closed finished end that is used to attached adjacent side panels of the modular container together through elongated piping support structures, in accordance with the embodiments of the invention.
Figure 5B:
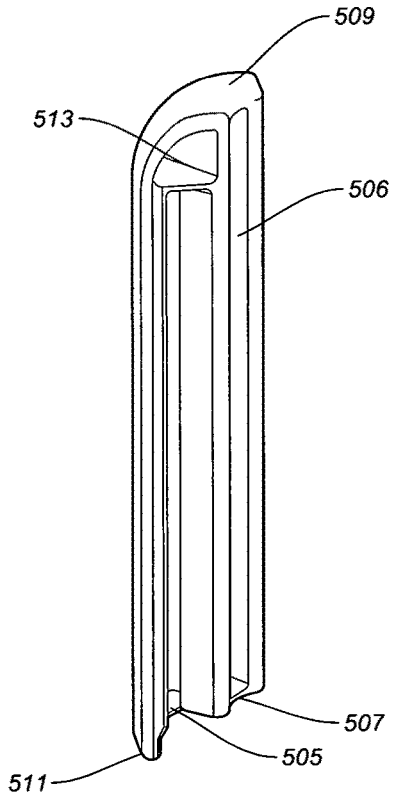
Figure 5C:
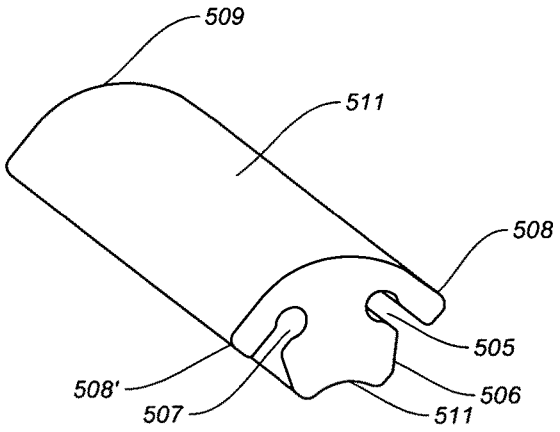
Figure 5D:
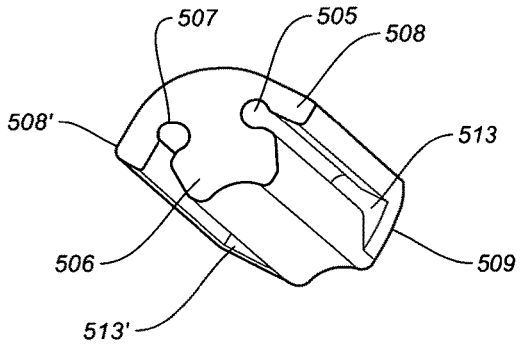

FIG. 4 shows an exploded view of a modular container 400 with corner couplers 421, 421' and 421", side panels 403, 405, 407 and 409, a bottom panel 401, a top panel or cover 411 and a sectional insert or compartment divider 413. The corner couplers 421, 421' and 421" preferably have elongated channels 105 and 107 and an elongated tongue feature 106, such as described with reference to FIGS. 1A-B and FIG. 2.

The modular container 400 can also include a bottom panel or side panel inserts (not shown) that fit into an assembled modular container or are held within pocket or sleeves on the bottom panel 401 and/or side panels 403, 405, 407 and 409 to add rigidity to the assembled modular container 400. In further embodiments of the invention the modular container 400 includes dividers 413 that fit into the assembled modular container 400 and attaches to walls of the bottom panel 401 and/or side panels 403, 405, 407 and 409 through attachment features including, but not limited to, two part snap features, hook and loop fabric and matted tongue and grove-type slotted features or combinations thereof. The side panels 403, 405, 407 and 409, a bottom panel 401, a top panel or cover 411 are formed from the same materials or different materials. Suitable materials to form the side panels 403, 405, 407 and 409, a bottom panel 401, a top panel or cover 411 include, but are not limited to plastics or polymers, woven materials and cloth (with or without internal support structures), metals and composite materials.

The top panel 411 fits over a container cavity of the assembled modular container 400 and the side panels 403, 405, 407 and 409 and be detachably secured through portions of the corner couplers 421, 421' and 421". Any of the side panels 403, 405, 407 and 409 and/or top panel 411 can include handle features 431 on the outer surfaces for porting the assembled modular container 400. As described above, the corner couplers 421, 421' and 421" slide up and down, as indicated by the arrow 451 along edges 423 and 429 of adjacent side panels 403 and 409. The along edges 423 and 429 of adjacent side panels 403 and 409 preferably have elongated piping support structures that fit into the elongated channels on the corner couplers 421, 421' and 421", such as described above.

FIGS. 5A-D show a view 500 a corner coupler 501 with a two elongated channels 505 and 507, an elongated tongue feature 506, an open receiving end 511 and a closed finished end 509 that is used to attached adjacent side panels of the modular container together through piping support structures. The corner coupler 501 preferably has a curved or rounded front portion 511. The two elongated channels 505 and 507 are formed between lip features 508 and 508' and a elongated tongue feature 506. Within the two elongated channels 505 and 507 and near the closed finished end 509 of the corner coupler 510 there are stop features 513 and 513'. The stop features 513 and 513' prevent the elongated piping support structures 205 and 205' (FIG. 2) from being pushed any further into the two elongated channels 505 and 507 when assembling a modular container, such as described with reference to FIGS. 2-4. In this embodiment of the invention the closed finished end 509 will protrude up from top edges of an assembles modular container and be used to help support stacking of additional containers or can be used to secure to a top panel or lid feature that fits over a container cavity of the assembled modular container. A top panel or lid feature can be secured to the corner couplers of the assembled modular container using any suitable attachment mechanism including, but not limited to, compression fittings, hook and loop fabric, magnets, straps, snap features and combinations thereof.

As described above a modular container is assembled by sliding elongated piping support structures attached to adjacent side panels into two elongated channels at the open receiving ends each of the corner couplers. The corner couples can locked or secured into the assembled position by, for example, compression, snap features, matched lock features on the corner couplers and the bottom panels, side panels and/or on the elongated piping support structures or by any other suitable method.

The elongated piping support structures and the matched elongated channels have been described herein as having round cross-sectional shapes, but other cross-sectional shapes are envisioned including, but not limited to, square, triangular, hexagonal and irregular cross-sectional shapes, as long as pipping support structures can be fitted into and secured within the matched elongated channels. And while matched elongated channels are described herein as being continuous sectionalized matched channels are also contemplated. Corner couples of the present invention are used to assemble rectangular modular containers but can be configured to assemble modular containers with other shapes including, triangular, hexagonal or irregular shapes.

The present invention has been described in terms of specific embodiments incorporating details to facilitate the understanding of the principles of construction and operation of the invention. As such, references herein to specific embodiments and details thereof are not intended to limit the scope of the claims appended hereto. It will be apparent to those skilled in the art that modifications can be made in the embodiments chosen for illustration without departing from the spirit and scope of the invention.

What is claimed is:

1. A system to form a modular container comprising:

a) a container body that includes a bottom panel and side panels that are hingably attached to edges of the bottom panel;

b) elongated piping support structures that are co-molded to and permanently attached along each side edge of the side panels; and c) corner couplers with continuous elongated channels that have a cross-sectional shape that match the cross-sectional shape of the elongated piping support structures, such that the elongated piping support structures can be fitted into the continuous elongated channels and the corner couplers can be pushed down along two opposed elongated piping support structures on adjacent side panels to secure the adjacent side panels into an upright position and thereby securing the elongated piping support structures within the continuous elongated channels and forming the modular container, and wherein the cross-sectional shape of the elongated channels and the elongated piping support structures are circular.

2. The system of claim 1, wherein the corner couplers have closed finished ends with stop features that prevent the elongated piping support structures from being fitted into the matched elongated channels past the stop features.

3. The system of claim 1, wherein the modular container is rectangular with four rectangular side panels and a rectangular bottom panel.

4. The system of claim 1, further comprising a top panel or lid feature can be secured to the corner couplers of the modular container.

5. The system of claim 1, wherein the corner couplers secured onto the elongated piping support structures through one or more of compression, snap features, matched lock features on the corner couplers and the side panels and matched lock features on the corner couplers and the bottom panel.

6. A system to form a modular container comprising:

a) a container body that includes a bottom panel and four side panels that are hingably attached to four edges of the bottom panel;

b) elongated piping support structures that are co-molded to and permanently attached along each side edge of the four side panels; and c) corner couplers with continuous elongated channels that have a cross-sectional shape that match the cross-sectional shape of the elongated piping support structures, such that the elongated piping support structures can be fitted into the into the matched continuous elongated channels and the corner couplers can be pushed down along two opposed elongated piping support structures on adjacent side panels and to secure the adjacent side panels into an upright and assembled position and thereby securing the elongated piping support structures within the continuous elongated channels and forming the modular container, and wherein the cross-sectional shape of the elongated channels and the elongated piping support structures are round, square, triangular or hexagonal.

7. The system of claim 6, wherein the corner couplers have closed finished ends with stop features that prevent the elongated piping support structures from being fitted into the elongated channels past the stop features.

8. A system to form a modular container comprising:

a) a container body that includes a bottom panel and four side panels that are hingably attached to four edges of the bottom panel;

b) elongated piping support structures that are co-molded to and permanently attached along each side edge of the four side panels through elongated tab structures; and c) corner couplers with continuous elongated channels that have a cross-sectional shape that match the cross-sectional shape of the elongated piping support structures, such that the elongated piping support structures can be fitted into the into the continuous elongated channels and the corner couplers can be pushed down along two opposed elongated piping support structures on adjacent side panels and to secure the adjacent side panels into an upright and assembled position and thereby securing the elongated piping support structures within the matched continuous elongated channels and forming the modular container, and wherein the corner couplers have closed finished ends with stop features that prevent the elongated piping support structures from being fitted into the elongated channels past the stop features.

9. The system of claim 8, wherein the cross-sectional shape of the elongated channels and the elongated piping support structures are round, square, triangular or hexagonal.

* * * * *